US006964691B1

(12) United States Patent
Govoni et al.

(10) Patent No.: US 6,964,691 B1
(45) Date of Patent: Nov. 15, 2005

(54) METHOD OF PREPARING A SYNTHETIC FUEL FROM COAL

(75) Inventors: Donald E. Govoni, Joliet, IL (US); Ronald V. Davis, Geneva, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 10/667,619

(22) Filed: Sep. 22, 2003

Related U.S. Application Data

(63) Continuation of application No. 10/042,747, filed on Sep. 11, 2002, now Pat. No. 6,641,624, which is a continuation of application No. 09/751,501, filed on Dec. 29, 2000, now abandoned.

(51) Int. Cl.[7] ..... C10L 5/00
(52) U.S. Cl. ..... 44/620; 44/500
(58) Field of Search ..... 44/553, 500, 280, 44/620

(56) References Cited

U.S. PATENT DOCUMENTS

| | | | | |
|---|---|---|---|---|
| 3,717,574 A | | 2/1973 | Werneke | |
| 3,836,343 A | * | 9/1974 | Romey et al. | 44/553 |
| 3,974,116 A | | 8/1976 | Lissant | |
| 4,025,596 A | | 5/1977 | Parks et al. | |
| 4,033,852 A | | 7/1977 | Horowitz et al. | |
| 4,117,214 A | * | 9/1978 | Parks et al. | 44/601 |
| 4,167,398 A | * | 9/1979 | Hughes et al. | 44/553 |
| 4,168,614 A | | 9/1979 | Rieuz | |
| 4,287,111 A | | 9/1981 | Rieux | |
| 4,415,337 A | * | 11/1983 | Kutta et al. | 44/553 |
| 4,421,520 A | * | 12/1983 | Matthews | 44/501 |
| 4,455,149 A | | 6/1984 | Satake et al. | |
| 4,522,968 A | | 6/1985 | Horacek | |
| 4,555,329 A | | 11/1985 | Sykes et al. | |
| 4,632,750 A | | 12/1986 | McGarry | |
| 4,802,890 A | * | 2/1989 | Viles | 44/553 |
| 4,863,485 A | * | 9/1989 | Scafer et al. | 44/553 |
| 4,867,613 A | | 9/1989 | McLeod et al. | |
| 5,435,813 A | * | 7/1995 | Evans | 44/620 |
| 5,453,103 A | | 9/1995 | Ford | |
| 5,487,764 A | | 1/1996 | Ford, Jr. | |
| 5,599,361 A | | 2/1997 | Ford, Jr. | |
| 5,752,993 A | | 5/1998 | Eatough et al. | |
| 6,641,624 B1 | * | 11/2003 | Govoni et al. | 44/500 |

FOREIGN PATENT DOCUMENTS

| | | | |
|---|---|---|---|
| AU | 39889/93 | | 12/1993 |
| EP | 135785 | | 4/1985 |
| FR | 2683544 | * | 5/1993 |
| GB | 901789 | | 7/1962 |
| GB | 1152968 | | 5/1969 |
| JP | 48071383 | | 9/1973 |
| JP | 47-73232 | | 3/1974 |
| JP | 50-127005 | | 10/1975 |
| JP | 55-37999 | | 3/1982 |
| JP | 58118895 | A2 | 7/1983 |
| JP | 63033495 | A2 | 2/1988 |
| JP | 2000080356 | A2 | 3/2000 |

OTHER PUBLICATIONS

U.S. Appl. No. 08/134,697, filed Oct. 12, 1993, Gross et al.

* cited by examiner

*Primary Examiner*—Cephia D. Toomer
(74) *Attorney, Agent, or Firm*—Michael B. Martin; Thomas M. Breininger

(57) ABSTRACT

A method of preparing a synthetic fuel from coal comprising applying to the coal an aqueous emulsion of one or more reactive polymers and thoroughly mixing the coal to yield a complete reaction of the coal with the reactive polymers, wherein the reactive polymers are selected from the group consisting of ethylene/vinyl acetate copolymers, ethylene/vinyl alcohol copolymers, poly(acrylic acid), poly(vinyl alcohol), vinyl alcohol/vinyl acetate copolymers, poly(vinyl acetate), vinyl acetate/acrylic acid copolymers, poly(vinyl acetate/acrylic acid/ethylene), acrylic acid/acrylamide copolymers and poly(acrylamide).

6 Claims, No Drawings

METHOD OF PREPARING A SYNTHETIC FUEL FROM COAL

CROSS REFERENCE TO RELATED APPLICATIONS

This is a continuation of Ser. No. 10/042,747, filed Sep. 11, 2002, now U.S. Pat. No. 6,641,624, which is a continuation of Ser. No. 09/751,501, filed Dec. 29, 2000, now abandoned.

TECHNICAL FIELD

This invention concerns a method of preparing a synthetic fuel. More particularly, this invention is directed to a method of preparing a synthetic fuel from coal comprising reacting the coal with a reactive polymer and to a coal-derived synthetic fuel prepared by reacting coal with the reactive polymer.

BACKGROUND OF THE INVENTION

A synthetic fuel is a manmade material synthesized by the union of chemical elements, groups, or simpler compounds or by the degradation of a complex compound and is used to produce heat or power by burning. The majority of synthetic fuels are generated by the degradation of complex materials such as coal, oil shale, oil sand or natural gas. Synthetic fuel generation by the degradation of complex organic materials typically requires energy in the form of heat, as well as pressurized processing conditions, special chemical catalysts and highly reactive chemical reagents. Synthetic fuels produced through degradation of complex materials are often toxic flammable liquids or gases that require special storage and handling. Typical examples of synthetic fuels are synthetic oil produced from coal, synthetic gas (syngas) produced from coal, synthetic diesel fuel derived from natural gas, synthetic gasoline derived from natural gas, synthetic oil derived from oil shale and synthetic oil derived from oil sand.

A second means of producing a synthetic fuel is to react a complex organic material with a second reagent to yield a new material without degradation. Reactions of coal with numerous simple organic chemicals are well documented and are often used to study the various reactive chemical functional groups present in coal. Examples of reactions of coal with organic chemicals include acetylation with acetic anhydride and alkylation with benzyl bromide. Such reactions can impart beneficial properties to a fuel product and allow the production of coal derived solid synthetic fuels with lower toxicity and easier handling than traditional synthetic fuels. Although many reactions of organic reagents with coal are known, the products of such reactions do not demonstrate sufficiently advantageous fuel properties to justify the high cost of large-scale synthetic fuel production.

Coal-based synthetic fuels can conceivably be used in any application where coal is used, however, most coal-derived synthetic fuels are used in one of two industries, electric power generation and coke production. In electric power generation, coal-based synthetic fuels are typically burned alone or with coal in power generation facilities. In coke production, the synthetic fuel can be used alone or with metallurgical coal. In this case the coal used to produce synthetic fuel must be metallurgical grade coal.

Asphalt emulsions, oil emulsions and carboxylated styrene butadiene copolymers have been used as additives to generate synthetic fuels. Synthetic fuels made from these suffer from disadvantages in that their lower reactivity results in higher dosage requirements and the attendant cost. These materials also typically add significant moisture to the coal, giving the resulting material lower BTU value. In certain crushing and grinding operations where a particular particle size is desired, the particles have been shown to re-agglomerate due to the presence of the additive. Handling problems may result from the presence of the additive. These products may also have attendant environmental and health concerns due to the presence of volatile organic compounds. Some of the additives require acid treatment of the coal which raises health and liability concerns at synthetic fuel production sites. Potentially hazardous conditions arise due to the high temperatures needed to feed and maintain some synthetic fuel additives. Incompatibility of the synthetic fuel additives with synthetic fuel plant equipment such as conveyor belts has been observed at some sites.

An object of the invention is to provide a method of preparing a synthetic fuel from coal that has advantages over existing technology in the areas of handling, synthetic fuel milling and pulverizing, additive toxicity and environmental acceptability.

SUMMARY OF THE INVENTION

In its principal aspect, this invention is directed to a method of preparing a synthetic fuel from coal comprising reacting the coal with a polymer composition comprising an aqueous solution or an aqueous emulsion of one or more reactive polymers, the reactive polymers selected from the group consisting of ethylene/vinyl acetate copolymers, ethylene/vinyl alcohol copolymers, poly(acrylic acid), poly (vinyl alcohol), vinyl alcohol/vinyl acetate copolymers, poly (vinyl acetate), vinyl acetate/acrylic acid copolymers, poly (vinyl acetate/acrylic acid/ethylene), acrylic acid/acrylamide copolymers and poly(acrylamide).

One advantage of the present invention is that synthetic fuels made as described herein have a lower polymer composition dosage requirement with attendant cost savings.

Another advantage is that the polymer compositions described herein do not add appreciable moisture to the coal. Therefore, the synthetic fuel shows no reduction in BTU value when compared to the parent coal.

Another advantage is in improved control of dusting of the synthetic fuel product.

Another advantage is improved handling characteristics exhibited by synthetic fuel produced according to this invention. In common end-use operations, such as crushing and grinding to a desired particle size, the particles show no tendency to re-agglomerate due to the presence of the additive.

Another advantage is reduced safety, environmental and health concerns due to the absence of volatile organic compounds in synthetic fuel prepared as described herein.

Another advantage is that this invention does not require acid treatment of the coal, thereby lessening health and liability concerns at synthetic fuel production sites.

Another advantage is that the method of this invention does not require elevated temperatures, resulting in lower safety concerns compared to other synthetic fuel additives.

Another advantage is that synthetic fuel prepared as described herein is compatible with plant equipment such as conveyor belts.

DETAILED DESCRIPTION OF THE INVENTION

A synthetic fuel is produced from coal according to this invention by applying to the coal a requisite amount of a reactive polymer selected from ethylene/vinyl acetate copolymer, ethylene/vinyl alcohol copolymer, poly(acrylic acid), poly(vinyl alcohol), vinyl alcohol/vinyl acetate copolymer, poly(vinyl acetate), vinyl acetate/acrylic acid copolymer, poly(vinyl acetate/acrylic acid/ethylene), acrylic acid/acrylamide copolymer or poly(acrylamide), or a mixture thereof such that the polymer reacts with the coal. The resultant product can be shown by the analytical methods described herein to be chemically different from either the parent coal or the polymer additive.

Ethylene/vinyl acetate copolymer is commercially available from several sources including Reichhold Chemicals, Research Triangle Park, N.C. (Elvace 714); Air Products Inc., Allentown, Pa. (Airflex 315); and National Starch and Chemical, Bridgewater, N.J. (Dur-O-Set E-130). Commercially available ethylene/vinyl acetate copolymer has the following characteristics:

Ethylene: 1 to 75% by weight.

Polymer particle size distribution maximum: 1%>200 mesh.

pH: 4.00–7.00.

Percent solids: 5 to 80%.

Viscosity: 100 to 5000.

Preferred ethylene/vinyl acetate copolymer has 6 to 8% ethylene, a maximum of 500 ppm of particles >200 mesh, a molecular weight distribution of from about 190,000 to about 250,000, a pH of about 4 to about 5.5, about 54.5 to about 56 percent solids, a viscosity of from about 1500 to about 2700 and residual vinyl acetate monomer of less than about 0.1%.

Ethylene/vinyl alcohol copolymer is commercially available from Aldrich Chemical Company, Milwaukee, Wis.

Poly(acrylic acid) is commercially available from Air Products Inc.; Nalco Chemical Company, Naperville, Ill.; and Rohm & Haas Company, Philadelphia, Pa.

Poly(vinyl alcohol) is commercially available from Air Products Inc.

Vinyl alcohol/vinyl acetate copolymer is commercially available from Poly Sciences, Inc., Warrington, Pa. and Dajac Laboratories, Inc., Feasterville, Pa.

Poly(vinyl acetate) is commercially available from Air Products Inc. and National Starch and Chemical.

Vinyl acetate/acrylic acid copolymer is commercially available from Air Products, Inc.; and The Glidden Company, Cleveland, Ohio.

Poly(vinyl acetate/acrylic acid/ethylene) is commercially available from Air Products Inc.; Rohm & Haas Company; and E.I. duPont de Nemours and Company, Wilmington, Del.

Acrylic acid/acrylamide copolymer is commercially available from Aldrich Chemical Company and Nalco Chemical Company.

Poly(acrylamide) is commercially available from Nalco Chemical Company.

Although coal derived solid synthetic fuel production facilities display variation in individual plant components, all facilities seek to accomplish the same common steps in coal derived solid synthetic fuel production. These steps include: delivering the coal to a section of the plant where the reaction will take place, adding the reactive polymer to the coal in the reaction section of the plant in a manner to insure complete reaction with the reactive polymer and transportation of the coal from the region where the reaction takes place to a region for storage of the fuel prior to transport.

In a typical facility, coal is transported on a conveyor belt to a reaction region. This reaction region will contain a mixing device such as a pugmill and means to insure substantially complete contact of the reactive polymer with the coal, such as a spray section wherein the coal falls through several sprays of reactive polymer.

The reactive polymer is pumped from a bulk storage tank and sprayed using standard fan spray nozzles onto the coal at the end of the belt such that the desired reaction mixture enters the pugmill. The reaction mixture is then thoroughly mixed in the pugmill and the product is transported via conveyor belt to a storage area. The reactive polymer feed rate may be maintained at a constant level, proven in testing to yield a complete reaction throughout the normal plant variation in coal feed rate. Alternatively, the feed of the reactive polymer may be automated and allowed to vary to compensate for changes in coal feed rate. The latter may be accomplished using continuous coal feed rate monitoring equipment such as belt scales, continuous reactant additive feed rate monitoring equipment such as an electronic liquid flow meter and data acquisition/control equipment such as PID controllers.

Several factors influence the minimum reactive polymer dosage required to sufficiently react with the coal. These factors fall under the categories of those related to the coal and those related to the process. Coal related factors include, but are not limited to, the size distribution of the coal particles, the concentration of reactive chemical groups in coal, the degree of oxidation of the coal, the tendency of the coal to readily release volatile organic molecules upon heating (low vol vs mid vol vs high vol coals) and the ash (inorganic matter) content of the coal. Process related factors include, but are not limited to, degree of mixing of the reactants, the temperature of the process and the presence of washing or other processing steps that might halt or otherwise prevent the completion of the reaction. Thus, in practice the minimum reactive polymer dose requirement is unique for each coal and each production facility. Polymer dose requirements can vary within a given coal seam. A typical dose is from about 3 to about 5 tons of reactive polymer per ton of untreated coal.

The reactive polymer is added to the coal as an aqueous emulsion or aqueous solution. This aqueous emulsion or aqueous solution may be further diluted with water and/or one or more organic diluents. Since selection of the reactive polymer concentration is a function of the ability to evenly distribute the reactants, good mixing allows the reactive polymer composition to be added neat (i.e., without further dilution), whereas poor mixing requires dilution of the reactive polymer composition to insure good distribution throughout the reaction mixture. The level of dilution necessary is a function of the efficiency of the mixing. While dilution of the reactive polymer benefits the contact between the reactants, minimization of the amount of diluent is advantageous in order to limit the addition of non or poorly combustible material that could lower the BTU value of the fuel product. Likewise, the minimization of the addition of volatile organic diluents is required to prevent problems with handling, milling, grinding and pulverizing of the fuel product.

Representative diluents include water or water miscible organic solvents such as alcohols, ketones, carboxylic acids or esters of carboxylic acids. Dilution with water reduces the stability of the polymer suspension and requires constant agitation unless inline mixing of the reactant additive with water is utilized just prior to the mixing of the reactants. In the case of water dilution, the reactive polymer is typically applied at a concentration of from about 10 to about 100 percent by weight as received from the supplier, with the neat product preferred.

"Alcohol diluent" means a straight or branched alkyl group or phenyl group substituted by one or more hydroxy groups. The alkyl is optionally interrupted by one or more oxygen atoms, provided that no two oxygen atoms are directly bonded to one another. Representative alcohol diluents include methanol, ethanol, propanol, phenol, ethylene glycol, propylene glycol, diethylene glycol, polypropylene glycol, glycerine, Dowfroth 250 (a polypropylene glycol available from Dow Chemical Company, Midland, Mich.), and the like.

"Ketone diluent" means a water soluble compound of formula RC(O)R' where R and R' are alkyl. A representative ketone diluent is acetone.

"Carboxylic acid diluent" means a water soluble compound of formula $R''CO_2H$ where R" is H or alkyl. Representative carboxylic acid diluents include formic acid, ethanoic acid, and the like.

"Carboxylic acid ester diluent" or "ester diluent" mean a water soluble compound of formula $R''CO_2R$ where R" is H or alkyl and R is alkyl. Representative ester diluents include methyl acetate, ethyl acetate, and the like.

Overdosing of organic diluents can cause rapid curing of the emulsion or formation of an unstable suspension. Thus, minimization of organic diluents is necessary. Dilution with organic diluents has the advantage of yielding a stable suspension of the polymer with a substantially lower viscosity. An added benefit is that organic dilutions yield an improved low temperature viscosity profile.

Glycols such as ethylene glycol, diethylene glycol, propylene glycol and glycerine yield low viscosity stable suspensions at low dilution levels. High boiling glycols such as diethylene glycol and glycerine that do not volatilize during high temperature processing, such as crushing, milling and grinding of the fuel, are preferred. In the case of dilution with water miscible organic solvents, the reactant additive is typically applied at a concentration of 75% to 95% as received.

PREFERRED EMBODIMENTS

In a preferred aspect of this invention, the polymer composition comprises an aqueous emulsion of vinyl acetate/ethylene copolymer.

In another preferred aspect, the polymer composition further comprises one or more diluents.

In another preferred aspect, the diluents are selected from the group consisting of water, alcohols, ketones and carboxylic acids and esters.

In another preferred aspect, the diluent is water.

In another preferred aspect, the diluent is alcohol.

In another preferred aspect, the alcohol is selected from the group consisting of ethylene glycol, diethylene glycol, propylene glycol and glycerine.

In another preferred embodiment, the alcohol is diethylene glycol.

In another preferred aspect, the coal is selected from the group consisting of fine coal from stockpiles, fine coal from impoundments, run of mine coal unwashed and run of mine coal washed.

In another preferred aspect, this invention is directed to a synthetic fuel prepared by reacting the coal with a polymer composition comprising an aqueous solution or an aqueous emulsion of one or more reactive polymers, the reactive polymers selected from the group consisting of ethylene/vinyl acetate copolymers, ethylene/vinyl alcohol copolymers, poly(acrylic acid), poly(vinyl alcohol), vinyl alcohol/vinyl acetate copolymers, poly(vinyl acetate), vinyl acetate/acrylic acid copolymers, poly(vinyl acetate/acrylic acid/ethylene), acrylic acid/acrylamide copolymers and poly (acrylamide).

Analytical Methods

Several analytical methods can be employed in the evaluation of reactions between coal and an a reactive polymer to form a synthetic fuel. These include Fourier-transform infrared spectroscopy (FTIR), solid state carbon NMR, GCMS, elemental analysis, proximate analysis, x-ray fluorescence and thermogravimetric analysis (TGA) techniques. FTIR, TGA and proximate analysis methods have proven particularly suited to the identification and investigation of chemical reactions of coal. These techniques are described in detail below.

Fourier-transformed, infrared spectroscopy (FTIR) is used to probe the chemical composition of coals. It gives information about the relative amounts of structural groups within the coal. Changes in the positions of spectral features and/or the relative areas under spectral peaks can be suggestive of a chemical reaction and resultant changes in the composition of the materials. Statistical analyses on multiple samples of a given coal suggest that there is a minimum average peak area difference that is representative of a significant chemical change in the synthetic fuel product relative to the parent materials.

The FTIR measurements described herein are performed by Combustion Resources (Provo, Utah) to evaluate the chemical reaction between reactive polymers and coal. Standard analytical techniques are employed. In a typical analysis, a weighed amount of dried untreated coal is ground to fine particle size, added to a weighed amount of potassium bromide and mixed well. The mixture is then pressed into a pellet and the FTIR spectra of the untreated coal obtained. Potassium bromide is chosen due to its lack of significant IR features in the region of interest (400 to 4000 $cm^{-1}$). A similar procedure is then used to obtain the spectra of the dried treated coal. The FTIR spectrum of the reactive polymer, either as a liquid film on an Attenuated Total Reflectance (ATR) crystal or as a liquid solution in a liquid FTIR cell, is then obtained. Common FTIR subtraction techniques may be used to remove the IR bands derived from water.

Using software commonly available with modern computer controlled FTIR instruments, a linear combination spectra is generated by adding the untreated coal spectrum, multiplied by a factor related to its weight percent in the treated coal, to the chemical additive spectrum, likewise multiplied by a factor related to its weight percent in the potential synthetic fuel. This linear combination spectrum indicates the expected FTIR result if the reactive polymer and the coal underwent no chemical reaction. A peak-by-peak evaluation of the difference between individual peak areas for the linear combination and the treated coal is then performed.

Since the area of FTIR bands are a function of both the concentration of the species producing the bands and the strength of the dipole moment change of the motion yielding the band, the magnitude of the FTIR band area is not an accurate measure of importance. Significant differences in chemical structure are often only revealed by changes in relatively weak IR bands. In order to weight all the FTIR bands equally, the results of the peak-by-peak comparison are reported as absolute percent change in the individual IR bands using the band appearing in the FTIR of the linear combination spectrum as 100%. The percent change in the individual IR bands is then summed and divided by the total number of bands analyzed. Statistical analysis of untreated coal FTIR measurements indicates that total peak-by-peak area measurement differences greater than 12% are consistent with a chemical reaction. A total peak area percent difference greater than 20% is typically accepted as unambiguous proof by FTIR analysis alone that a new material has been formed by a chemical reaction between a coal and the reactive polymer. Good analytical practice requires corroborating evidence from other methods, such as TGA, when the FTIR peak-by-peak area measurement difference is between 15% and 20%.

An alternative method relies on using an ATR cell to obtain the FTIR spectra. However, the signal-to-noise ratio for such spectra is generally poor relative to KBr pellets due to the lower level of IR active material being irradiated. Also, the IR throughput of ATR crystals is generally much less than other IR methods. Substantial signal averaging can help to improve the ATR FTIR spectra.

For ATR measurements performed on solids it is necessary to subtract or otherwise exclude the air derived $CO_2$ bands from the analysis. Likewise, if the coal and potential synthetic fuel is not dried prior to FTIR measurement, the water bands must be subtracted or excluded from the analysis. In a typical analysis a small amount of sample (coal or treated coal) is placed on the ATR crystal and a spectrum is obtained from an average of several scans. The spectrum of the reactive polymer is similarly obtained from a liquid film applied to the ATR crystal. A linear combination spectrum is then generated by adding the untreated coal spectrum, multiplied by a factor related to its weight percent in the potential synthetic fuel, to the chemical additive spectrum, multiplied by a factor related to its weight percent in the treated coal. A difference spectrum is then generated by subtracting the linear combination spectrum from the treated coal spectrum. Based on a statistical analysis of untreated coal samples, a difference between the simple mixture spectrum total peak area and the treated coal spectrum total peak area of greater then 15% indicates a chemical reaction has taken place between the reactive polymer and the coal.

Thermogravimetric analysis (TGA) is used to probe the chemical composition of coals. It gives information about the combustion characteristics of a material. Changes in the combustion profile of a material can be suggestive of a chemical reaction. Differences in the combustion profiles of a synthetic fuel product relative to the parent coal can represent a chemical change in the synthetic fuel product relative to the parent coal. It should be noted, however, that a chemical reaction between the coal and the reactive polymer will not necessarily result in an alteration of the fuel's TGA profile relative to the parent coal in all cases.

In a typical TGA experiment, a weighed amount of the dried reactive polymer, dried untreated coal and dried treated coal are each added to TGA sample boats. The TGA profile is then obtained for each sample and a linear combination of the reactant additive profile and the untreated coal profile is prepared by summing the individual profiles multiplied by a factor related to the weight percent of the respective material in the treated coal. Statistical analysis of untreated coal samples indicates that differences in peak pyrolysis rates of greater than 3.5% and differences in high temperature pyrolysis rates of greater than 5% are consistent with the formation of a new material by a chemical reaction between coal and the reactive polymer. Good analytical practice requires that differences in peak pyrolysis rates of greater than 5% and high temperature pyrolysis rates of 7% are generally accepted as consistent with a chemical reaction between the reactive polymer and the coal to yield a new material.

Analytical results from the aforementioned tests and possibly other tests are used together, and with proper and expert interpretation, to determine if a reaction has occurred between the coal and the reactive polymer. The analytical tests described above are used to quantify the amount of reactive polymer required to produce a synthetic fuel with different coal samples and methods of application. In the following examples, a series of coal-derived synthetic fuels are prepared by using a polyvinyl acetate/ethylene copolymer emulsion with different parent coals, obtained from different geographical areas, and using different application methods.

In Examples 1–5, the ethylene/vinyl acetate copolymer emulsion contains 6–8% ethylene. Representative ethylene/vinyl acetate copolymer emulsions are Reichhold Elvace 734-00 and Air Products AirFlex 315.

EXAMPLE 1

A 20% dilution with water of an ethylene/vinyl acetate copolymer emulsion is added at varying dosages to samples of parent coal. In this example an approximately 1 kg sample of run of mine Alabama metallurgical coal, having an approximate size consist of 2/0 is used. The coal/polymer blend is then thoroughly mixed and the resultant mixture is then submitted to an independent laboratory for analysis using the foregoing tests. The results of this analysis are summarized in Table 1. These results indicate that a chemical reaction occurred between the coal and the ethylene/vinyl acetate copolymer to form a synthetic fuel.

TABLE 1

Analysis of Reaction Product of Ethylene/Vinyl Acetate Copolymer and Alabama Metallurgical Coal

| Weight percent ethylene/vinyl acetate copolymer | FTIR Percent Total Band Area Change | TGA Percent Peak Pyrolysis Rate Change |
|---|---|---|
| 0.1 | 15 | 2 |
| 0.125 | 11 | 2 |
| 0.15 | 14 | 1 |
| 0.175 | 14 | 1 |
| 0.2 | 16 | 3.5 |
| 0.225 | 18 | 3 |
| 0.25 | 19 | 0 |
| 0.275 | 22 | 3 |

EXAMPLE 2

The ethylene/vinyl acetate copolymer emulsion of Example 1 is added at varying dosages to samples of parent coal. In this example, an approximately 1 kg sample of run of mine West Virginia Bluestone metallurgical coal, having an approximate size consist of 2/0 is used. The material is then thoroughly mixed and the resultant mixture is then submitted to an independent laboratory for analysis. The results of this analysis are summarized in Table 2. These results indicate that a chemical reaction occurred between the coal and the ethylene/vinyl acetate copolymer to form a synthetic fuel.

TABLE 2

Analysis of Reaction Product of Ethylene/Vinyl Acetate Copolymer and West Virginia Bluestone Metallurgical Coal

| Weight percent ethylene/vinyl acetate copolymer | FTIR Percent Total Band Area Change | TGA Percent Peak Pyrolysis Rate Change |
|---|---|---|
| 0.15 | 8 | 0.5 |
| 0.3 | 15 | 10 |
| 0.45 | 20 | 7 |

EXAMPLE 3

The ethylene/vinyl acetate copolymer emulsion of Example 1 is added at varying dosages to samples of parent coal. In this example, an approximately 1 kg sample of run of mine Eastern Kentucky coal having an approximate size consist of 2/0. The material is then thoroughly mixed and the resultant mixture is then submitted to an independent laboratory for analysis. The results of this analysis are summarized in Table 3. These results indicate that a chemical reaction occurred between the coal and the ethylene/vinyl acetate copolymer to form a synthetic fuel.

TABLE 3

Analysis of Reaction Product of Ethylene/Vinyl Acetate Copolymer and Eastern Kentucky Coal

| Weight percent ethylene/vinyl acetate copolymer | FTIR Percent Total Band Area Change | TGA Percent Peak Pyrolysis Rate Change | TGA Percent High Temperature Pyrolysis Rate Change |
|---|---|---|---|
| 0.125 | 12 | 1 | 0 |
| 0.15 | 10 | 3 | 2 |
| 0.175 | 17 | 5 | 4 |
| 0.2 | 30 | 1 | 4 |
| 0.225 | 30 | 5 | 4 |
| 0.25 | 18 | 2 | 0 |
| 0.275 | 28 | 1 | 0 |

EXAMPLE 4

An undiluted sample of an ethylene/vinyl acetate copolymer emulsion is added at varying dosages to samples of parent coal. An approximately 1 kg sample of run of mine Southwestern Virginia coal having an approximate size consist of 2/0. The material is sprayed onto a conveyor belt before the resultant mixture is mixed in a pug mill. The resultant mixture is then submitted to an independent laboratory for analysis. The results of this analysis are summarized in Table 4. These results indicate that a chemical reaction occurred between the coal and the ethylene/vinyl acetate copolymer to form a synthetic fuel.

TABLE 4

Analysis of Reaction Product of Ethylene/Vinyl Acetate Copolymer and Southwestern Virginia Coal

| Weight percent ethylene/vinyl acetate copolymer | FTIR Percent Total Band Area Change | TGA Percent Peak Pyrolysis Rate Change | TGA Percent High Temperature Pyrolysis Rate Change |
|---|---|---|---|
| 0.1[1] | 14.33 | 4.66 | 4.66 |
| 0.15[2] | 17 | 5.75 | 8 |
| 0.2[3] | 18.33 | 7.25 | 8.5 |

[1]Average of 3 runs.
[2]Average of 4 runs.
[1]Average of 3 runs.

EXAMPLE 5

The ethylene/vinyl acetate copolymer emulsion of Example 1 is added at varying dosages to samples of parent coal. In this example, an approximately 1 kg sample of run of mine Central Pennsylvania coal having an approximate size consist of 2/0. The material is then thoroughly mixed and the resultant mixture is then submitted to an independent laboratory for analysis. The results of this analysis are summarized in Table 5. These results indicate that a chemical reaction occurred between the coal and the ethylene/vinyl acetate copolymer to form a synthetic fuel.

TABLE 5

Analysis of Reaction Product of Ethylene/Vinyl Acetate Copolymer and Central Pennsylvania Coal

| Weight percent ethylene/vinyl acetate copolymer | FTIR Percent Total Band Area Change | TGA Percent Peak Pyrolysis Rate Change |
|---|---|---|
| 0.1 | 14 | 5 |
| 0.125 | 17 | 5 |
| 0.15 | 18 | 4 |
| 0.175 | 21 | 6 |
| 0.2 | 20 | 8 |
| 0.225 | 18 | 9 |
| 0.25 | 26 | 6 |
| 0.275 | 20 | 12 |

EXAMPLE 6

The properties of representative reactive polymer compositions prepared by diluting the ethylene/vinyl acetate copolymer emulsion of Example 4 with various organic diluents are summarized in Table 6.

TABLE 6

Properties of Diluted Ethylene/Vinyl Acetate Copolymer Emulsion

| Organic Diluent | Weight Percent | Stability | Viscosity (75° F.) | Viscosity (40° F.) |
|---|---|---|---|---|
| None | 0 | Y | 1800 | 2680 |
| Ethylene glycol | 5 | Y | 720 | 1020 |
| Ethylene glycol | 25 | Y | 160 | 200 |
| Diethylene glycol | 5 | Y | 760 | 1120 |
| Diethylene glycol | 25 | Y | 200 | 280 |
| Propylene glycol | 5 | Y | 880 | 1220 |
| Propylene glycol | 25 | Y | 280 | 420 |
| Glycerine | 5 | Y | 760 | 1140 |
| Glycerine | 25 | Y | 200 | 280 |
| Acetone | 5 | Y | 1020 | 1360 |
| Acetone | 25 | Y | 440 | 440 |
| Formic acid | 5 | Y | 2040 | 3200 |
| Formic acid | 25 | Y | 1660 | 2600 |
| Ethyl acetate | 5 | Y | 2800 | 3720 |
| Ethyl acetate | 25 | N | >11,000 | >11,000 |

It should be understood that various changes and modifications to the presently preferred embodiments described therein will be apparent to those skilled in the art. Such changes and modifications can be made without departing from the sphere and scope of the present invention and without diminishing its intended advantages. It is therefore intended that all such changes and modifications be covered by the intended claims.

We claim:

1. A method of preparing a synthetic fuel from coal comprising applying to the coal an aqueous emulsion comprising (a) one or more reactive polymers and (b) one or more alcohols and thoroughly mixing the coal to yield a complete reaction of the coal with the reactive polymers, wherein the reactive polymers are selected from the group consisting of ethylene/vinyl acetate copolymers, ethylene/vinyl alcohol copolymers, poly(acrylic acid), poly(vinyl alcohol), vinyl alcohol/vinyl acetate copolymers, poly(vinyl acetate), vinyl acetate/acrylic acid copolymers, poly(vinyl acetate/acrylic acid/ethylene), acrylic acid/acrylamide copolymers and poly(acrylamide).

2. The method of claim 1 wherein the reactive polymer is ethylene/vinyl acetate copolymer.

3. The method of claim 1 wherein the coal is selected from the group consisting of fine coal from stockpiles, fine coal from impoundments, run of mine coal unwashed and run of mine coal washed.

4. The method of claim 1 wherein the alcohol is selected from the group consisting of ethylene glycol, diethylene glycol, propylene glycol and glycerine.

5. The method of claim 1 wherein the alcohol is diethylene glycol.

6. A synthetic fuel prepared according to the method of claim 1.

* * * * *